US008457341B2

(12) United States Patent
Danley

(10) Patent No.: US 8,457,341 B2
(45) Date of Patent: Jun. 4, 2013

(54) SOUND REPRODUCTION WITH IMPROVED LOW FREQUENCY CHARACTERISTICS

(76) Inventor: Thomas J. Danley, Highland Park, IL (US)

( * ) Notice: Subject to any disclaimer, the term of this patent is extended or adjusted under 35 U.S.C. 154(b) by 1263 days.

(21) Appl. No.: 12/225,020

(22) PCT Filed: Mar. 14, 2007

(86) PCT No.: PCT/US2007/006483

§ 371 (c)(1),
(2), (4) Date: Sep. 11, 2008

(87) PCT Pub. No.: WO2007/109075

PCT Pub. Date: Sep. 27, 2007

(65) Prior Publication Data

US 2009/0087008 A1 Apr. 2, 2009

Related U.S. Application Data

(60) Provisional application No. 60/782,401, filed on Mar. 15, 2006.

(51) Int. Cl.
*H04R 1/20* (2006.01)

(52) U.S. Cl.
USPC ..... 381/340; 84/338; 84/339; 84/341; 84/342; 84/345

(58) Field of Classification Search
USPC ..... 381/340, 341, 342
See application file for complete search history.

(56) References Cited

U.S. PATENT DOCUMENTS

| | | | | |
|---|---|---|---|---|
| 2,461,005 | A * | 2/1949 | Southworth | 342/6 |
| 2,768,246 | A * | 10/1956 | Klein | 381/167 |
| 4,860,367 | A * | 8/1989 | Hook | 381/341 |
| 6,094,495 | A * | 7/2000 | Rocha | 381/340 |
| 6,118,883 | A * | 9/2000 | Rocha | 381/387 |
| 2007/0258617 | A1* | 11/2007 | Henry | 381/423 |
| 2008/0247595 | A1* | 10/2008 | Henry | 381/398 |
| 2009/0087008 | A1* | 4/2009 | Danley | 381/341 |
| 2009/0136072 | A1* | 5/2009 | Danley | 381/340 |
| 2010/0119081 | A1* | 5/2010 | Aylward | 381/98 |
| 2010/0278368 | A1* | 11/2010 | Martin et al. | 381/340 |

OTHER PUBLICATIONS

"Analysis of a Low-Frequency Loudspeaker System", Peter Tappan, Jan. 1959, vol. 7, No. 1, Journal of the Audio Ehgineering Society.*

* cited by examiner

*Primary Examiner* — Marlon Fletcher
(74) *Attorney, Agent, or Firm* — Olson & Cepuritis, Ltd.

(57) ABSTRACT

A sound reproduction system (10) is disclosed in which a sound barrier (14) defines a horn passageway having an upstream (22) and a downstream section (24). A driver (12) is mounted at the throat (16) of the upstream section (22) so that its rearward directed output communicates with the downstream section (24). Output from the upstream section and the rearward directed output of the driver are merged at a tap point located at the beginning of the downstream section. By altering the respective areas and lengths of the upstream and downstream sections a variety of different frequency dependent responses are obtained. In one example, low-frequency response systems of heretofore unobtainable compact size are realized.

11 Claims, 6 Drawing Sheets

SOUND REPRODUCTION WITH IMPROVED LOW FREQUENCY CHARACTERISTICS

CROSS-REFERENCE TO RELATED APPLICATIONS

This application is a U.S. National Stage of PCT/US2007/006483, filed Mar. 14, 2007, and claims benefit of U.S. Provisional Patent Application No. 60/782,401, filed Mar. 15, 2006, each of which is incorporated herein by reference in its entirety.

FIELD OF THE INVENTION

The present invention relates to sound reproduction systems having one or more drivers coupled to a sound barrier.

DESCRIPTION OF THE RELATED ART

Originally, the art of horn loading of drivers was done to increase the electroacoustic efficiency of the drivers. Various techniques were employed early on to make the most of limited amplifier power and relatively low power handling capabilities of available drivers. Early efforts were centered around obtaining the greatest sound level possible. Horn loaded speakers, sometimes referred to simply as "horns", of this early era were generally designed to have a specific expansion rate throughout, and typically were made to have a defined shape such as that of a simple cone as well as curved wall flares having shapes corresponding to exponential or hyperbolic curves. Typically, these designs were aimed at giving the best low-frequency performance.

Complementary horn/driver systems were developed for different frequency ranges. The design of relatively low frequency horns encountered challenging problems because of the mass and acoustic size required. Once the desired frequency range is made high enough, it becomes easier to make a horn for a particular range which is large enough to meet design criteria. However, difficulties arose in attempts to make a horn driver having a relatively flat acoustic power response above 2 or 3 kHz. It was possible to design drivers early on to have a reasonably flat response "on-axis" to several octaves above a low range, largely because these horns typically have a "curved wall" construction which exhibited a directivity which narrows with increasing frequency. Many popular early designs had favorable response characteristics because the narrowing "focus" of the horn pattern closely compensated for the falling acoustic power of the horn drivers, with increasing frequency. However, situations arose where listeners could not be positioned "on axis". Most notably, severe high frequency roll off was experienced as a listener moved away from the central axis of the sound reproduction system.

Constant directivity horns were developed in an effort to provide a consistent sound quality to larger audiences, so as to overcome the focusing effect of curved wall horns. Unfortunately, practical constant directivity horns produced considerably less low-frequency loading on the drivers than the popular exponential-shape curved wall horns for which improvements were sought. Fortunately, power amplifiers having greater output were made available and horn drivers were being produced with greater power capability.

When a given low frequency horn (a system which is a combination of a horn and at least one driver) is altered to make the mouth area smaller than "ideal", what was a "flat response" begins to show a series of peaks and dips which become prohibitively large as the mouth becomes smaller still. The peaks and valleys in the response of a compact or "too small" bass horn system reflect the increasing differences in the radiation impedance-vs-frequency that the horn presents as a load to the driver mounted at the throat. According to accepted horn theory, a horn in "full space" (such as if flown hanging from a long cable from a helicopter etc) needs to have a mouth size (which is relative to the wavelength being produced) with a circumference of about 1 wavelength. For a 20 Hz horn, this would suggest an impractical mouth diameter of 18 feet. Accordingly, sound reproduction systems of more compact, manageable size are still being sought.

SUMMARY OF THE INVENTION

The present invention provides a novel and improved sound reproduction system. In a first embodiment a sound barrier defines a horn passageway having a first throat end and a second open end. At least one driver having first and second sound outputs in different directions is provided. A sound barrier defining a horn passageway having first and second horn sections, with a throat end and an open end is located between the first and the second horn sections. The driver is mounted to the sound barrier so that the first sound output is carried in the first horn section and the first and a second sound outputs are carried in the second horn section.

Preferably, a system for reproducing sound includes at least two drivers. each having first and second sound outputs in different directions. A sound barrier defining a horn passageway has a pair of first horn sections and a second horn section, with a pair of throat ends and an open end located between the first and the second horn sections. The drivers are mounted to the sound barrier so that their respective first sound outputs are carried in the respective first horn sections, and the first and second sound outputs of the drivers are carried in the second horn section.

DESCRIPTION OF THE PREFERRED EMBODIMENTS

Figure 1:
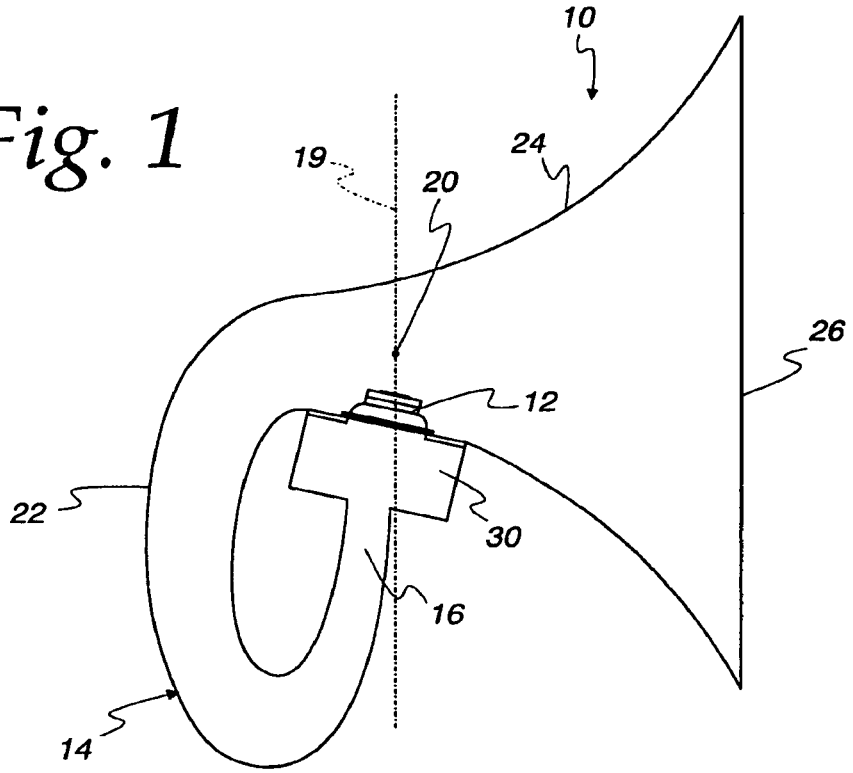
FIG. 1 is a schematic cross-sectional view of a sound reproduction system illustrating the present invention.

The invention disclosed herein is, of course, susceptible of embodiment in many different forms. Shown in the drawings and described herein below in detail are the preferred embodiments of the invention. It is to be understood, however, that the present disclosure is an exemplification of the principles of the invention and does not limit the invention to the illustrated embodiments.

For ease of description, sound reproduction systems embodying the present invention are described herein below in their usual assembled position as shown in the accompanying drawings and terms such as front, rear, upper, lower, horizontal, longitudinal, etc., may be used herein with reference to this usual position. However, the sound reproduction systems may be manufactured, transported, sold, or used in orientations other than that described and shown herein.

At the outset it is noted that, while many different types of sound reproduction systems can receive substantial benefit from the present invention, the present invention has found immediate acceptance in the field of horn/driver sound reproduction systems. As will be seen herein, the present invention, in one aspect, is directed to horn-loaded driver systems of heretofore unattainable sound quality in a compact size arrangement, significantly reduced from a theoretical "ideal" size to a more practical size suitable for use in a practical working environment. As contemplated herein, a horn is an air passageway defined by one or more walls that are acoustically solid, presenting an acoustic boundary which contains the sound pressure until the sound signals reach the horn mouth. Accordingly, in an effort to reduce discontinuities in the acoustic boundaries of the horn, and to avoid adding soft surfaces within the acoustically solid horn wall, drivers are located, where possible, outside of the horn passageway, with both parts of a their sound output introduced into the horn interior passage via rigid connections.

In one aspect, the present invention is directed to sound reproduction systems in which one or more drivers are loaded by a horn having two or more combined horn sections which cooperate with the driver so as to have the driving source properties change with frequency. In another aspect, the present invention is directed to a technique of loading both sides of a driver with a common horn loading so that the acoustic impedance the driver presents to the sound reproduction system changes beneficially with frequency. The present invention finds immediate application for use as a limited bandwidth device, particularly low frequency horn systems, and especially such systems intended for use below 100 Hz (commonly referred to as a woofer or subwoofer sound reproduction system).

As is known in the art, the design of sound reproduction systems often involves a balancing of different design principles, directed to optimizing different aspects of system performance. The present invention can be combined with a wide variety of techniques known in the art, to provide sound reproduction systems which simulate a single acoustic source in time with a single source radiation pattern, and with heretofore unattainable dynamic, frequency dependent phase shift characteristics. While known techniques have enjoyed some measure of success, substantially greater performance is made possible only with the present invention, as can be seen for example, by comparing the responses shown in FIGS. 3 and 5, and described below. It has been discovered that certain aspects of the horn design must be satisfied if a dynamic frequency dependent phase shift is to be achieved in a system of heretofore unattainable small size.

A horn need not be driven at its apex or throat. For example, as disclosed by the inventor of the present invention in U.S. Pat. No. 6,411,718, one can actually tap into the horn anywhere along its length, with the acoustic impedance determined by the area and expansion properties of the horn passageway, which typically changes along the length of the horn. In addition to the usual issues related to driver parameters, there is an additional issue of the frequency limit of the sound system (compared to a conventionally driven horn), where a horn is driven forward of the throat due to reflected sound which travels from the driver to the closed throat being reflected back so as to interact with the driver.

A typical response for a horn driven forward of the apex or throat (by a mid or tapped horn) has a fairly good response at its low frequency end, but as the frequency rises, a broad rise occurs, as the reflected radiation is more in phase and adds to the driver radiation. As the frequency rises further, the output rolls off and has a deep notch at the frequency where the acoustic distance from the radiator to the throat and back is one half wavelength and so represents a signal exactly out of phase with the driver radiation, which is accordingly canceled out. As the frequency rises, a series of peaks and dips, and in general a roll off above the operating range, is noted in the system response. In some horn systems constructed according to U.S. Pat. No. 6,411,718, an acoustic roll off filter above the cutoff reduces harmonic distortion by attenuating driver output above the crossover frequency.

With tapped horn systems according to principles of the present invention this 180 degree phase shift that one sees in a one quarter wavelength reflection can be replaced by a passageway of greater length and driven by a signal already 180 degrees out of phase (i.e. the backside signal of the same driver), so that when forward and backward signals from the same driver are combined, they add and do not cancel. The backward signal component is conceptually like a typical transmission line or delay line enclosure although the typical transmission line has no taper or a reverse taper, and is not intended for acoustic loading. In tapped horns constructed according to principles of the present invention, the expansion rate of the horn passageway provides acoustic loading down to the low cutoff. Also, unlike the transmission line, the horn passageway of a tapped horn constructed according to principles of the present invention continues past the combining point of the front and rear radiation (see reference number 20 in FIG. 1). Horn systems constructed according to principles of the present invention have greater efficiency than a transmission line and also provide greater loading on the driver in order to minimize the needed driver excursion or to maximize the sound output for a given driver excursion limit.

Figure 6:
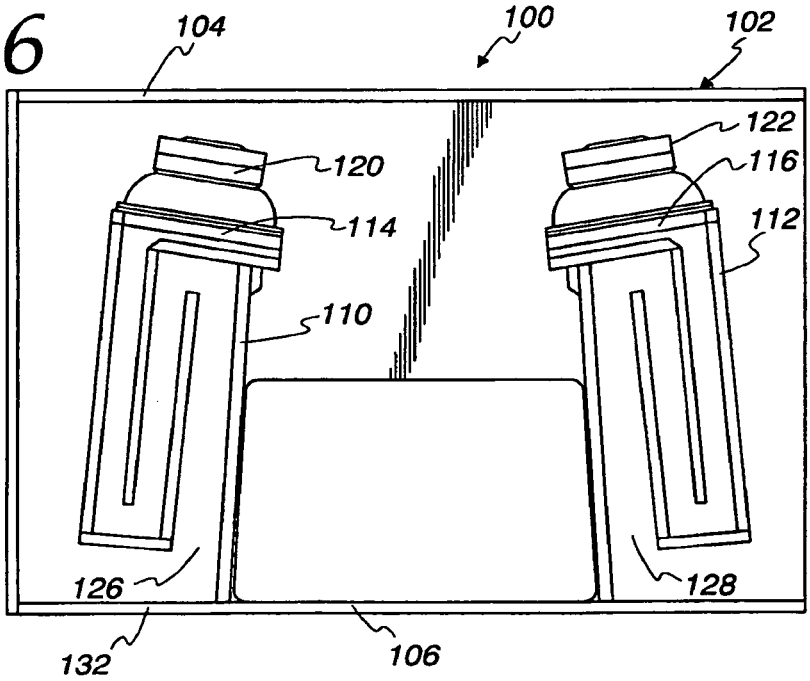
FIG. 6 is a schematic cross-sectional view of another sound reproduction system embodying the present invention.
Figure 7:
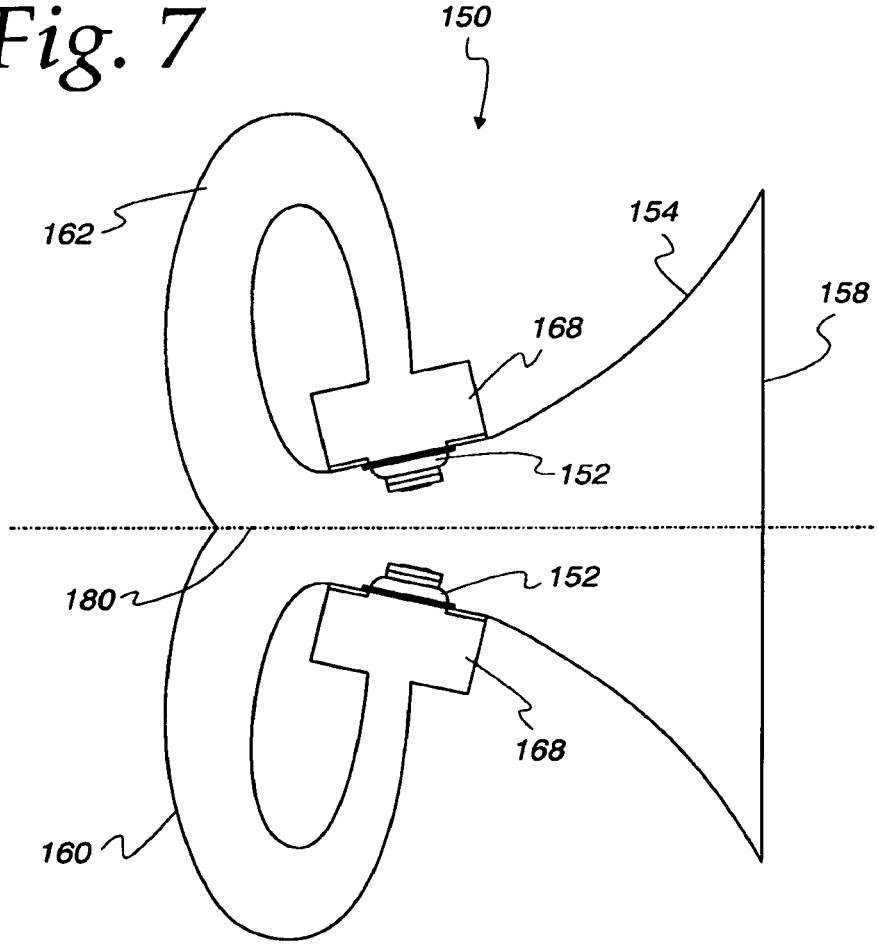
FIG. 7 is a schematic cross-sectional view of the reproduction system of FIG. 6.

Referring now to FIG. 1, a sound reproduction system embodying certain aspects of the present invention is generally indicated at 10. A driver 12 is mounted at the throat 16 of an acoustic boundary, or sound barrier 14, which preferably functions as a horn, loading the driver 12. The sound barrier or horn 14 can take any of the number of desirable shapes and forms, as well as different expansion rates and the cross-sectional areas as may be needed for a particular application. The present invention, as will be seen herein, can be readily adapted to horns of virtually any shape, and is not limited to the shape shown in FIG. 1. For example, FIG. 6 shows a horn constructed of flat wall panels, throughout. Further, while a single driver 12 is illustrated in FIG. 1, there can be any number of drivers as may be required. For example, FIGS. 6 and 7 show sound reproduction systems having a pair of drivers arranged to provide a common sound output.

Referring again to FIG. 1, sound barrier 14 is comprised of first and second horn sections meeting at a vertical reference plane 19 which extends through reference point 20. The first or upstream horn section 22 of the sound barrier extends from mouth 16 to the reference plane, while the second or downstream horn section 24 extends from the reference plane to the mouth 26. As indicated in FIG. 1, substantial portions of driver 12 are disposed in the horn passageway, adjacent the reference plane or boundary between the horn sections. This arrangement provides a simpler, more cost-effective construction. If desired, the driver can be mounted outside of the horn passageway (in the manner indicated for example in FIG. 2) so as to avoid introducing soft surfaces in the path of the pneumatic signals emanating from driver 12.

As a further possibility, driver 12 can be mounted directly to throat 16 of sound barrier 14. However, it is generally preferred that a transition air volume or throat cavity 30 be provided to couple output from driver 12 to the throat 16. Throat chamber or cavity 30 provides a small air volume for compliance between the driver and the horn throat. This throat cavity volume, in addition to the mass reactance of the air in the throat, forms a low pass filter which can be used to extend the high frequency-3 dB point, while having a steeper roll off afterwards. While this small air volume of the throat cavity affects the high frequency response of the overall system, it has essentially no effect on the low frequency response (i.e. the limited bandwidth range of operation for which the system is intended). This effectively forms a "low pass" filter which is desirable since it reduces the ever-present harmonic distortion components higher than the low pass frequency. The present invention also contemplates a system employing multiple stages of the type illustrated in FIG. 1. For example, the two stages can accommodate adjacent frequency bands, with one frequency band having a higher range of frequencies than the other.

Figure 2:
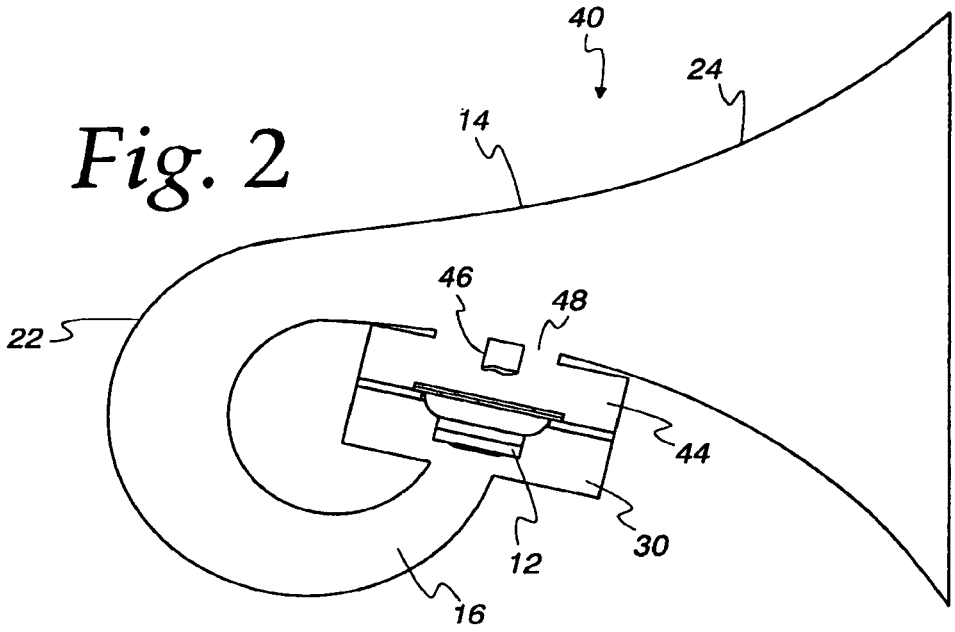
FIG. 2 is a schematic cross-sectional view of a preferred embodiment of a sound reproduction system illustrating the present invention.

Referring now to FIG. 2, a sound reproduction system is generally indicated at 40. The system 40 utilizes many features of the sound reproduction system 10 schematically illustrated in FIG. 1. For example, the same horn or sound barrier 14 is employed, with an upstream or first horn section 22 and a downstream or second horn section 24. A small air cavity 30 is employed for compliance between the forward end of driver 12 and throat 16. Output from the reverse or rearward side of driver 12 is coupled to the downstream portion of the horn passageway, where it combines with driver output traveling along the upstream horn section 22. Thus, system 40 also comprises a tapped horn system. As a feature unique to the system schematically illustrated in FIG. 2, an additional small air volume enclosed in a chamber 44 couples rearward output from driver 12 to a tap opening 48 formed in sound barrier 14 at a point where the upstream and downstream horn sections 22, 24 meet. Preferably, chamber 44 provides a rigid mounting for driver 12 to the sound barrier. The air volume defined by chamber 44 cooperates with one or more hollow cylinders or ports 46 positioned in opening 48, to form an acoustic low pass filter on the "tap" or rearward side of the driver (i.e., that side of the driver directly feeding the downstream section 24 of the horn or sound barrier 14. Preferably, the air volume of chamber 44, and the diameter and length of port 46 are adjusted to form a low pass filter at or above the highest frequency of interest. This low pass filter affects only the high frequency response of sound reproduction system 40, and has essentially no effect on the system low frequency response (which is functionally unlike a conventional ported low frequency alignment, where system radiation is primarily above the low pass filter corner).

Figure 3:
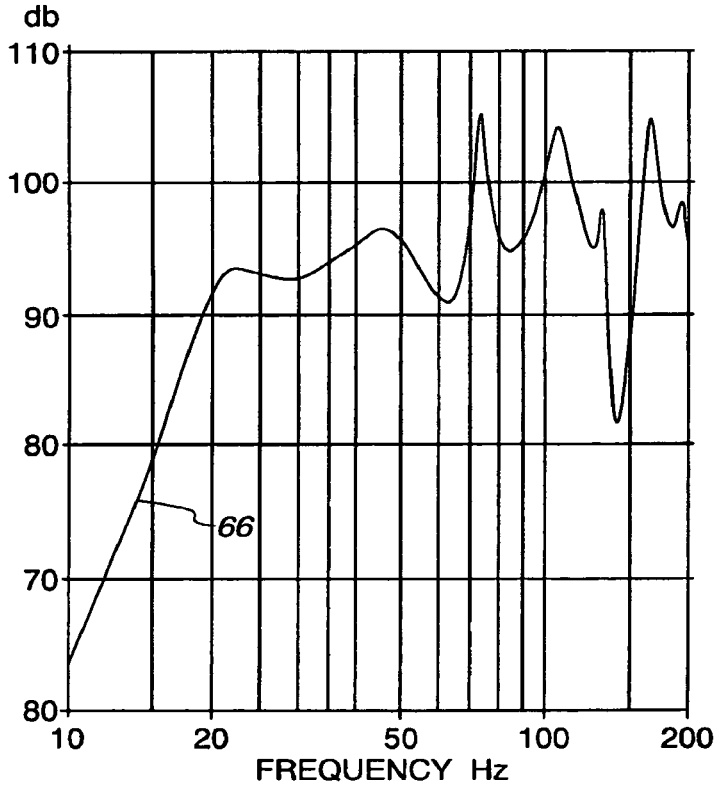
FIG. 3 is a graphical representation of the performance of the sound reproduction system of FIG. 1.

Referring to FIG. 3, a response curve for the horn system schematically illustrated in FIG. 1 is shown. The response indicates a notch and roll off in the high frequency range above passband, but the low frequency response is constant and well developed.

Figure 4:
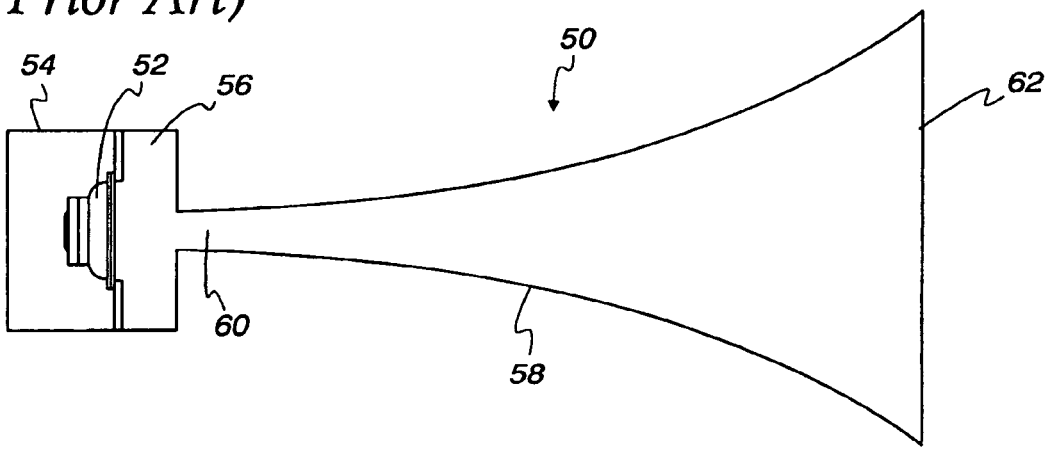
Fig. 4 (Prior Art)
FIG. 4 is a schematic cross-sectional view of a prior art sound reproduction system.
Figure 5:
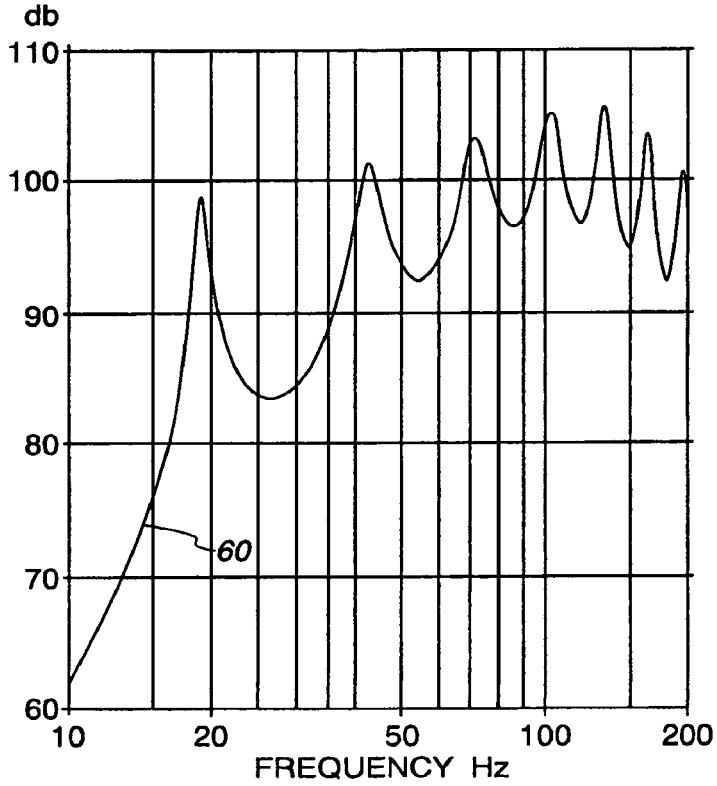
FIG. 5 is a graphical representation of the performance of the sound reproduction system of FIG. 4.

Referring to FIGS. 4 and 5 for comparison purposes, and to illustrate advantages attainable with the present invention, a prior art horn/driver sound reproduction system generally indicated at 50 was analyzed. Included in system 50 is a driver 52 having a rearward enclosure 54, a forward compliance section 56 and a horn 58 having a throat 60 and a mouth 62. The horn 58 is preferably formed in a conventional manner.

Referring to FIG. 5, the system 50 was tested for frequency response characteristics. The frequency response curve 60 is shown for the conventional system. The frequency response curve of FIG. 3 shows substantial improvement over the performance of the conventional system shown in FIG. 4, whose response is indicated in FIG. 5. With sound reproduction systems according to principles of the present invention curve is smoother than the curve indicated in FIG. 5. Sound reproduction systems according to principles of the present invention have much less group delay than conventional systems, even though the same drivers are used in both systems.

Exemplary principles of operation of the reproduction system will now be discussed. At the low frequency limit, one finds the one-quarter-wavelength resonance for the entire acoustic length (the rear horn section plus the front section of the horn) and mainly the rear side of the driver feels the acoustic load because of the nearly 90 degree phase shift between the two sides. This "entire acoustic length" is actually comprised of the path lengths of both the upstream and downstream sections and the compliance effect of the front or forward volume between the horn and driver. In practice, the physical length may actually best be slightly greater than one-quarter wavelength in the "minimum size" horn.

Above the low frequency corner, the phase shift between the rear radiation and front radiation is less than 90 degrees when they combine and so begin to add constructively. Somewhere in the mid frequency band, both sides of the radiator feel acoustic loading from the horn. In this way the driver now has acoustic impedance, which varies as a result of loading of one side at some frequencies and loading both sides at another. At the same time, what one wants as a driver when the horn is too small is a driver which can have one set of properties ideal for operation at or near the quarter wave resonance, and a different set of properties at higher frequencies where the horn area is more correct and provides a more proper conventional loading. Such performance is provided in sound reproduction systems constructed according to principles of the present invention.

For a given "compromised" or compact size horn mouth and box size, the tapped horn will have a lower cutoff and or less response ripple than any conventional horn alignment. However in the tapped horn case, the shift is accompanied by a time delay in the acoustic path, not caused by a Helmholtz resonator inverting the phase.

In the proximity of the low cutoff, the horn is considered to be operating at about the quarter wave resonance, driven by a driver, preferably one which is far from what would be conventionally recommended for a normal half wave length long horn. The other ("rearward" or reverse) side of the driver, which is out of phase and normally in a sealed box, is also connected to the horn passage but is connected some distance away than the other input from the driver. It should be noted that this path length distance provides a frequency dependent phase shift between the two pressures as they add within the horn.

There are at least two portions to the horn, the downstream part from the "tap" to the mouth or outlet and the upstream, tap or "loop" part which connects one side of the driver to the other at the "far" end. A variation would be a horn that had two or more loop paths and multiple drivers (see for example FIGS. 6 and 7). For simplification, consider that the frequency is such that at low cutoff, the acoustic length of the loop (between each side of the driver) is 90 degrees in phase or one quarter wavelength in acoustic length. Note, this acoustic length may well be somewhat longer than consideration of the sound velocity in free space and frequency alone would suggest. With a 90-degree phase shift between the two pressures, they neither add nor cancel. At that point, only the side of the driver at the end of the horn (i.e. the forward side at the throat and feeding the upstream and horn section) feels the acoustic load produced by the one-quarter-wavelength resonance. The other side of the driver, at the tap point (i.e. the rearward side facing the tap and directly feeding the downstream horn section), being 90 degrees different in phase, does not feel the pressure created by the resonance, as it is 90 degrees out of phase. Here, effectively only one side of the driver (i.e. the forward side at the throat and feeding the upstream horn section) is coupled to the acoustic load.

As the frequency rises, the phase shift between two driver outputs becomes less than 90 degrees. Recall that the two sides of the driver are, of physical necessity, always 180 degrees out of phase, due to the fact that if the traveling portion of the driver moves out on one side, it necessarily moves in on the other. As the frequency is increased; the fixed physical path length between the two sides represents an increasing phase shift. This means that as the frequency is increased above the low cutoff frequency, the phase shift between the two sides goes from 90 degrees to less than 90 degrees at which point output from the two sides of the radiator begin to add together. At a frequency where the phase shift in the upstream or loop path is 180 degrees, both sides of the radiator are driving the horn "in phase" and as such, the driver has a significantly larger effective radiator area (with both sides feeling the radiation pressure) with very different driver parameters than with operation at the one quarter wavelength resonance.

The tapped horn allows the driving source of the horn to have different acoustic impedance at the low cutoff, more suited for efficient operation at the quarter wave resonance. As the frequency rises, (through the increasing addition of both sides of the radiator) the driving impedance conforms more closely to what is needed. Simply put, at the quarter wave resonance, only one side of the driver faces the radiation pressure but as the frequency climbs, both sides of the driver face the pressure. This makes a driver with parameters, which change automatically, depending on frequency. This allows a single driver to span the requirements for efficient quarter wave operation well into the range where it is one half wavelength long or more.

As mentioned above with reference to FIGS. 1 and 2, a "throat cavity" or chamber defining an "air volume" is employed in the sound reproduction systems according to principles of the present invention. This throat cavity is a commonly used, small air volume (compliance) placed between the driver and horn throat. When sized correctly, this volume, in addition to the mass reactance of the air in the throat, forms a low pass filter, which can be used to extend the high frequency 3 dB point while having a steeper roll off afterwards. While the throat cavity affects the high frequency response, it has essentially no effect on the low frequency response. This "low pass" filter effect is a desirable feature as it reduces the ever-present harmonic distortion components higher than the low pass frequency. On tapped horns according to principles of the present invention, the volume of the throat cavity is usually used also for the same reasons.

As mentioned herein, in one aspect, the present invention provides two (or more) sources of drive into the horn body. A typical response for a horn driven forward of the apex or throat (i.e. by a mid or tapped horn) has a fairly good response at its low frequency end but a broad rise occurs as the frequency rises (and before the notch frequency). This rise in response from the "tap" driving position allows the front volume for the "end" connection to be made larger, to a value which would normally excessively roll off the high frequency response. This difference in now made up in the present invention by the increased output on the tapped position. This larger front volume on the end position driving point is now large enough to lower the quarter wavelength resonance for a given length. By a careful choice of this larger volume and the overall system response, one can lower the system's lower corner frequency somewhat, with only a modest increase in overall enclosure size.

With reference to FIG. 2, as mentioned, a tapped horn is shown with an additional acoustic low pass filter on the "tap" or reverse side of the driver. This consists of an air volume and mass coupled into the horn at the same point. The air volume, port diameter and length are adjusted to form a low pass filter at or above the highest frequency of interest. As before, this only affects the high frequency response, it has essentially no effect on the low frequency response and is functionally unlike a ported low frequency alignment (where system radiation is primarily above the low pass filter corner).

At this point, certain aspects of the design theory will now be discussed. Since a specific design includes what ever size the horn actually is (as opposed to the ideal case) and whatever fraction of radiation space it is in (e.g. on the ground vs. in the air), practical design's of a tapped horn are developed by iteration, modeling the actual physical realizations with a sophisticated acoustic modeling program such as AkAbak, a software simulation program for electro-mechano-acoustical networks commercially available from Dipl. Ing. Uwe Kempe Postanschrift Lagesche Str. 10-12, 32657 Lemgo, Germany. Design is preferably initiated by laying out a horn model which has about a one-quarter wavelength total path length and has the throat connected to one side of the driver (s), that fits in the package size. Tap in the other side of the driver (s) at about ¼ to ⅓ of the way from the mouth. Observe the notch in the response related to the high frequency cutoff, which is related to the length of the "wrap around" path length. Fine tune the lengths and areas of the two horn paths and front and rear volumes to obtain the smoothest and greatest driver parameters effect.

In a horn closer to an ideal size (i.e. the size of a conventional low-frequency horn of an impractical large size), it is often the case that in the tapped horn according to principles of the present invention, the wrap around path (i.e. upstream path adjacent the throat) is smaller in area than the front path (i.e. downstream path adjacent the mouth). It is theorized that that this result arises because driving area is being added at the tap point, and thus the system has more radiation loading.

Alternately, as the mouth size of a tapped horn according to principles of the present invention is made smaller than an "ideal" size mouth, it is often the case that the wrap around path has little or no expansion in area, making it somewhat more like a duct, and is often the same size where it joins the downstream horn section. In this case the wrap around path provides the same phase shift as before, but with much less horn gain at the point where both radiations sum to join into the outlet portion of the horn.

Figure 8:
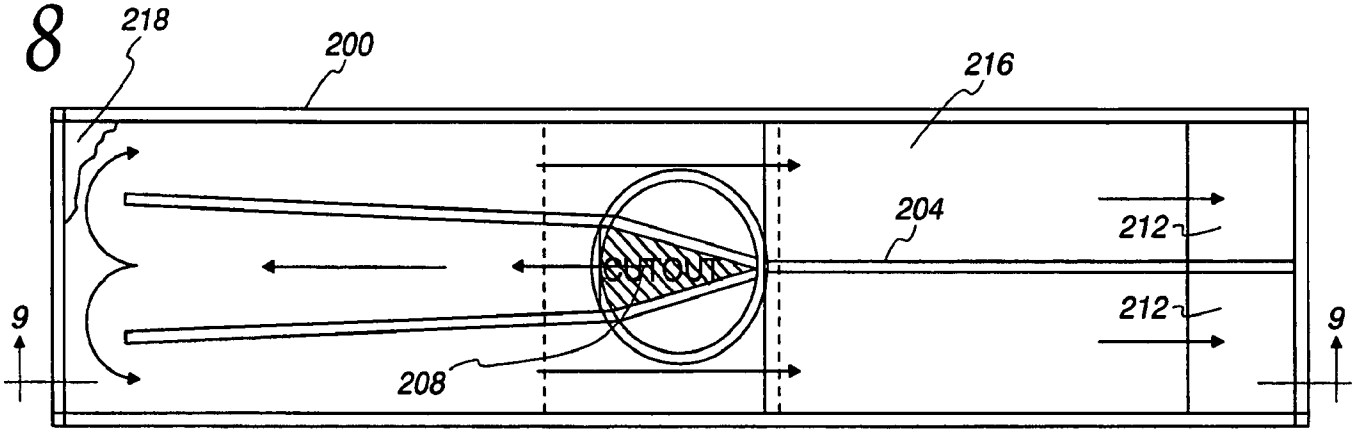
FIG. 8 shows a schematic view of another sound reproduction system embodying the present invention.
Figure 9:
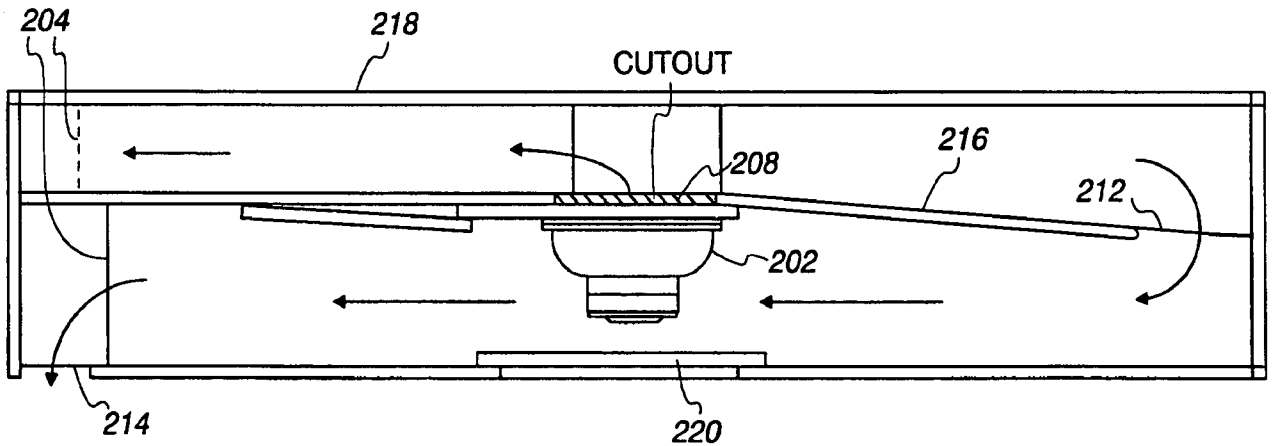
FIG. 9 shows a cross-sectional view taken along the line 9-9 of FIG. 8.
Figure 10:
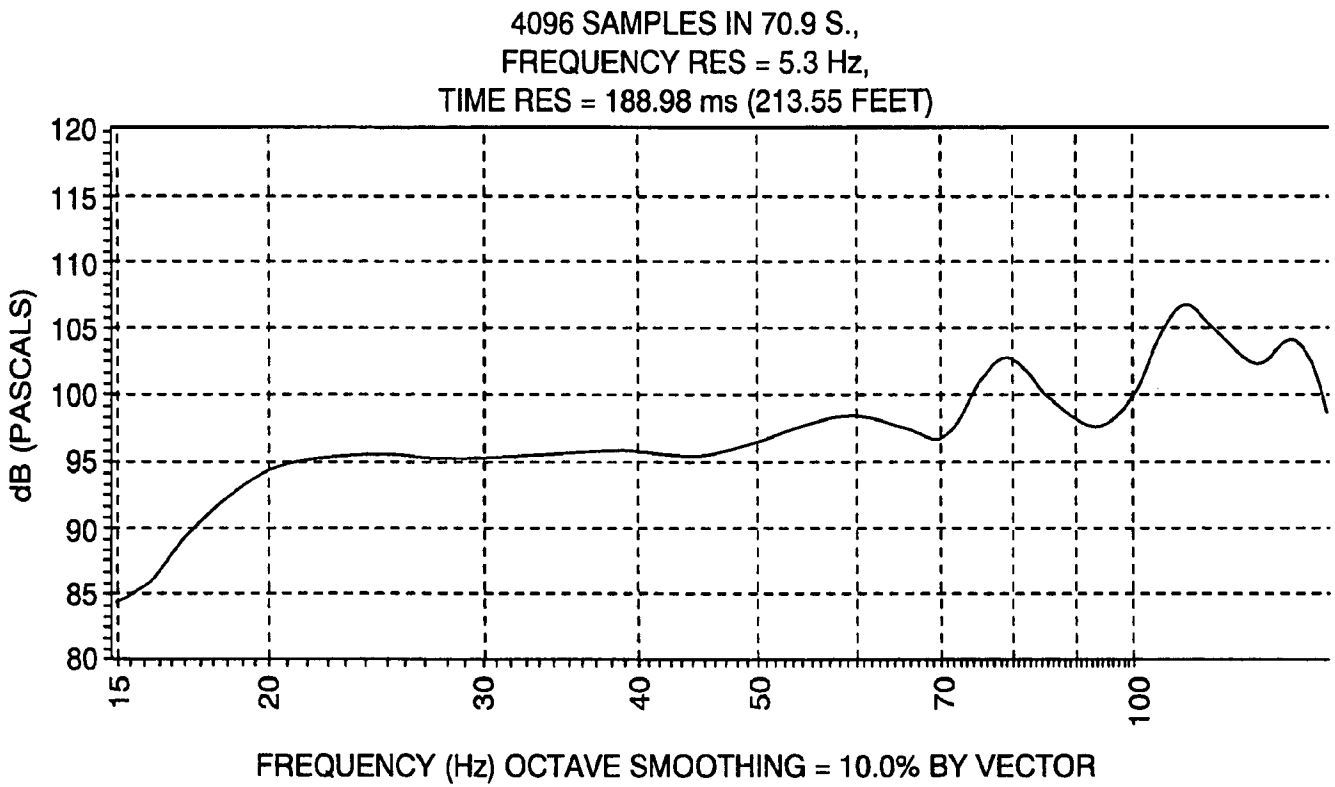
FIG. 10 is a graphical representation of the performance of the sound reproduction system of FIGS. 8 and 9.

It has been observed that the loop path has an expansion rate equal to or less than that needed for the design low cutoff frequency. It has also been observed that, as the horn is made much smaller than normal, the loop needs to become more reactive and so its area often expands more slowly and is smaller in magnitude than conventional systems. An example of a tapped horn with a slow expansion is given in FIGS. 8-10 which show an internal layout and a response curve, respectively. FIGS. 8 and 9 show a sound reproduction system 200 having a driver 202 mounted to a "full height" internal wall 204 having a throat cutout 208 (see FIG. 9). As can be seen in FIG. 8, (in which outer wall 218 is removed) internal wall 204 is generally "Y-shaped" so as to split the forward driver radiation in two paths which lead to an internal bend 212 and, after reversing direction, exit through outlet point 214, along divider wall 216. An access cover 220 is provided, as can be seen in FIG. 9. The driver 202, when placed in a conventional enclosure, has a normal sensitivity of 88 dB at one watt and one meter, but, when employed according to the present invention, has a 5 fold increase in sensitivity, measured at 95 dB at one watt and one meter.

The mouth coupler section also needs to have an expansion rate equal to or less than that required to achieve the desired low-frequency cut off. As with the upstream or loop section, the expansion rate, type and area of the downstream section determines the acoustic properties for each section, with each section of sound reproduction systems according to principles of the present invention being independently adjustable. While the total length of the horn air path is such that it operates at or near the quarter wave length resonance at the low cutoff frequency, the ratio of the loop or upstream path to mouth coupler or downstream path length define the rate at which the driver's source impedance (i.e. relative to the horn) changes with frequency. It is noted that making the loop path shorter requires a driver with a greater motor strength and moving mass but less displacement (for a given output). A short mouth coupler or long loop requires a lower mass, lower motor strength driver with more displacement.

When the horn is very small in mouth area compared to an ideal horn, there is a reflection related to the length of the loop path. Preferably, that operation is limited to frequencies below the notch in the response caused by such reflection. In larger tapped horns, such reflection can often be fully damped by the radiation and so be successfully suppressed. Both sections of horn have specific reactance and resistance based on the actual item, the driver is closely coupled and also has its own mass, stiffness and motor strength coupled at two places in the equivalent circuit. In a conventional horn, the rear volume emanating from the back of the driver acts as a spring or compliance, in parallel with the driver mechanical suspension. The volume emanating from the rear of the driver is adjusted to optimally cancel or annul the increasing reactance present in the horn as a low cutoff frequency is approached, to thus give an improved low frequency extension. In a tapped horn according to principles of the present invention, a specific compliance also yields the best results and, lacking the sealed chamber, the driver compliance is made to be less than in conventional systems and so the driver has a free air resonance which is higher than that of a conventional horn covering the same frequency.

With sound reproduction systems according to principles of the present invention, the cross-sectional area of the upstream or wrap around section can be altered (while keeping the total length of the horn path fixed) thereby providing an adjustment to the Q of the low frequency peak. Assuming, for example, a tapped horn arranged as a capital letter "P", moving the intersection up and down changes the effect a given driver has on the overall sound reproduction system in the same way as if one were adjusting the driver mass and motor strength etc. This is a matter of tuning the driver's position to optimally couple into the system. The advantage here is the ability to have the driver use one side or both sides of its radiator surface, depending on frequency. The choice of the two path lengths and areas, and the drivers parameters, combined with two resonant systems allows one to more effectively span the changing acoustic loads the compact horn presents, at least over a limited but well defined frequency span. Prototypes with a span of two octaves have been built and satisfactorily tested. Because of this additional "adjustment" capability with sound reproduction systems according to principles of the present invention, one can make a high output low frequency horn augmented enclosure that is smaller than with prior art horn designs, for a given amount of low cutoff ripple. Heretofore unobtainable adjustments in a system response made possible by the present invention allows drive properties in the tapped horn to be adjusted with changes to independent dimensions of both upstream and downstream acoustic sections.

It is believed that one reason that sound reproduction systems according to principles of the present invention can be made smaller than prior art designs is that the transition from driving from both sides of the radiator to driving it only one side at the low cutoff frequency better accommodates the changing radiation load imposed on the driver, going from the motional minimum at one quarter wavelength to the motional maximum at one half wavelength and so results in less ripple, or, for a given ripple magnitude, it results in a smaller physical package. In one example of a sound reproduction system constructed according to principles of the present invention, the system exhibited a sensitivity of about 102 dB for 1 Watt input, for one unit ground plane half space, with a–3 dB output at 29 Hz.

Using a vented box (the most common way to make a sound reproduction system having a low bass response in a 23 cu/ft package) the maximum sensitivity, assuming a "perfect driver," would be 97.9 dB for 1 Watt and –3 dB response at 29 Hz. In practical systems employing practical drivers, the driver response is typically down from a "perfect driver" response by 1 to 3 dB. Tapped horn sound reproduction systems according to principles of the present invention of approximately the same size (with a practical driver) measures more than twice this sensitivity. With sound reproduction systems employing two drivers of the type used conventionally in a vented box, a combined sensitivity of only 90 dB 1 W@1M is achieved. Measurements have indicated that the loading on radiators incorporated in a tapped horn according to principles of the present invention have an output raised by about 12 dB or a factor of 16, compared to the same drivers in direct radiation. Also, acoustic loads presented in sound reproduction systems according to principles of the present invention typically reduce the radiator motion by about a factor of 4, which then raises the maximum excursion limited output about 12 dB compared to the same drivers radiating directly.

Referring now to FIGS. 6 and 7, sound reproduction systems according to principles of the present invention having multiple drivers with multiple upstream horn sections will now be described. Referring to FIG. 6, a practical sound reproduction system is generally indicated at 100. A sound barrier 102 includes an outer enclosure 104 defining a mouth 106. A pair of upstream structures 110, 112 are provided with compliance barriers 114, 116 defining respective compliance inner chambers at the throat of the upstream structures. Drivers 120, 122 are mounted adjacent the throat of each upstream structure, as indicated in FIG. 6.

An opening 126, 128 of each upstream structure communicates with the interior of enclosure 104 adjacent a front wall 132 of the enclosure which defines mouth 106. In effect, the interior of enclosure 104 lying outside of the upstream horn sections 100 10, 112 forms a horn passageway which extends from the openings 126, 128 of the upstream structures to the mouth 106 of the sound reproduction system. Note that the backsides of drivers 120, 122 communicate with the horn passageway and thus two tap points are provided, adjacent the backside of each driver. At the tap points, outputs from the front and the rear of the drivers is combined, at the entrance to a downstream horn section. As with preceding embodiments, forward output from the drivers 120, 122 is controlled by an upstream horn section formed by the structures 110, 112 taken in combination with horn path sections extending between the openings 126, 128 and the rear of the drivers 120, 122. Note that the sound reproduction system 100, in its preferred embodiment, is constructed without curved wall sections.

Referring now to the dual driver arrangement of FIG. 7, a sound reproduction system constructed according to principles of the present invention is generally indicated at 150. Included are a pair of drivers 152 mounted to a sound barrier 154, and particularly that portion of the sound barrier forming a downstream horn section opening at a mouth 158. A pair of upstream horn sections 160, 162 blend with downstream horn section 154 at tap points located at the backsides of drivers 152. The front side of each driver 152 is loaded with a compliance member 168 which provides a transition to the upstream horn sections 160, 162. Note that the upstream horn sections 160, 162 merge at 180 and extend along a relatively short path portion immediately upstream of the backsides of drivers 152. If desired, the merge point 180 can be placed immediately adjacent the backsides of drivers 152 so as to alter the adjustable response of the sound reproduction system.

The sound reproduction system 150 produces a smoother amplitude response and lower phase shift response, as illustrated in FIG. 5, when taken in comparison with the response of a prior art system illustrated in FIG. 4. For systems constructed according to principles of the present invention, all of the drivers interact or "feel" each other acoustically, due to their close proximity and their loading into a mutually coupled horn passage.

The foregoing description and the accompanying drawings are illustrative of the present invention. Still other variations in arrangements of parts are possible without departing from the spirit and scope of this invention.

I claim:

1. A system for reproducing sound, comprising:

at least one driver having first and second sound outputs in different directions;

a sound barrier defining a horn passageway having first and second horn sections, with a throat end and an open end between the first and the second horn sections;

the driver being mounted to the sound barrier so that the first sound output is carried in the first horn section and the first and a second sound outputs are carried in the second horn section; wherein the at least one driver is mounted to a mid portion of the sound barrier, adjacent a boundary of the first and the second horn sections, and wherein said first sound output and said second sound output are combined within said horn passageway at said mid portion.

2. The system of claim 1 wherein the first and the second sound outputs extend in generally opposite directions.

3. The system of claim 1 wherein the sound barrier defines a continuous horn passageway including a first and the second horn sections.

4. The system of claim 1 wherein sound communication to the horn passageway for the second sound output is provided by an aperture in the sound barrier.

5. The system of claim 1 wherein the horn passageway is continuously curved.

6. The system of claim 1 wherein the horn passageway comprises a series of straight line path portions.

7. A system for reproducing sound, comprising:

at least two drivers, each having first and second sound outputs in different directions;

a sound barrier defining a horn passageway having a pair of first horn sections and a second horn section, with a pair of throat ends and an open end between the first and the second horn sections; and the drivers being mounted to the sound barrier so that their respective first sound outputs are carried in the first horn sections and the first and a second sound outputs of the drivers are carried in the second horn section; wherein the drivers are mounted to mid portions of the sound barrier, adjacent boundaries between the first and the second born sections, and wherein said first and second sound outputs are combined within said horn passageway at said mid portions.

8. The system of claim 7 wherein the first and the second sound outputs extend in generally opposite directions.

9. The system of claim 7 wherein the sound barrier defines a continuous horn passageway including the first and the second horn sections.

10. The system of claim 7 wherein sound communication to the horn passageway for the second sound output outputs of the drivers are provided by apertures in the sound barrier.

11. The system of claim 7 wherein the horn passageway comprises a series of straight line path portions.

* * * * *